US012247737B2

(12) United States Patent
Parra

(10) Patent No.: US 12,247,737 B2
(45) Date of Patent: Mar. 11, 2025

(54) SPARK CONCENTRATING FIRE STARTING TOOL

(71) Applicant: Jose J. Parra, Dublin, CA (US)

(72) Inventor: Jose J. Parra, Dublin, CA (US)

( * ) Notice: Subject to any disclaimer, the term of this patent is extended or adjusted under 35 U.S.C. 154(b) by 423 days.

(21) Appl. No.: 17/828,952

(22) Filed: May 31, 2022

(65) Prior Publication Data

US 2022/0390106 A1 Dec. 8, 2022

Related U.S. Application Data

(60) Provisional application No. 63/258,920, filed on Jun. 8, 2021.

(51) Int. Cl.
*F23Q 1/06* (2006.01)

(52) U.S. Cl.
CPC ..... *F23Q 1/06* (2013.01)

(58) Field of Classification Search
CPC ..... F23Q 1/06
USPC ..... 431/273
See application file for complete search history.

(56) References Cited

U.S. PATENT DOCUMENTS 4,770,669 A * 9/1988 Allen ..... C10L 11/00 44/510
5,279,628 A * 1/1994 Hutchens ..... C10L 11/00 44/507
5,919,037 A * 7/1999 Brillhart, III ..... F23Q 1/06 126/25 B
6,286,168 B1 * 9/2001 Woodruff ..... B25B 27/22 7/168
2011/0319864 A1 * 12/2011 Beller ..... A61M 5/2033 604/506
2015/0226429 A1 * 8/2015 Holland ..... F23Q 2/22 431/274

* cited by examiner

*Primary Examiner* — Avinash A Savani
(74) *Attorney, Agent, or Firm* — Cynthia S. Lamon; Lamon Patent Services

(57) ABSTRACT

According to an embodiment of the present invention, a fire starter tool is provided and includes a hollow case body having an open end and a closed end, a support platform disposed linearly from the closed end of the case body, an arcuate spark tunnel disposed on the end of the support platform the spark tunnel having a first open end facing the support platform and a second open end facing downward, a spark rod mounted to the support platform between the closed end of the case body and the first open end of the spark tunnel, a striker plate contained within the case body, and a cap for closing the open end of the case body.

20 Claims, 7 Drawing Sheets

SPARK CONCENTRATING FIRE STARTING TOOL

CROSS-REFERENCE TO RELATED DOCUMENTS

The present invention claims priority to a U.S. provisional patent application Ser. No. 63/258,920, entitled Spark Deflector Fire Starter, filed on Jun. 8, 2021 disclosure of which is incorporated herein at least be reference.

BACKGROUND OF THE INVENTION

1. Field of the Invention

The present invention is in the field of fire starter tools and accessories and pertains particularly to methods and apparatus for concentrating sparks struck with a striking tool from a flint rod to a protected ignitable target.

2. Discussion of the State of the Art

The use of spark-based fire ignition tools is well known in the art. Today, students and enthusiasts of the sport of survivalism rely on spark-based fire starter kits for the purpose of starting campfires or cooking fires in the wilderness areas they are traversing. A typical fire-starting kit may include a piece of flint and a carbon steel striking tool whereby the percussive action of the striker against the flint causes flakes of carbon steel to shed off and oxidize producing a low temperature spark. Getting the spark into tinder material is a challenge. One example of such a tool includes a magnesium block with a sparking (striking) tool insert attached to one side of the block. One problem with open air striking tools is that the sparks created are somewhat randomly fanned out in a general direction because of angular striking of the flint against the carbon steel and not necessarily focused directly onto an intended ignitable target such as a flammable dry medium like grass or shavings or other types of tinder like charcloth.

Another issue with spark-based fire starter tools is that high humidity, dampness, and windy conditions that are often present make preservation of the spark more difficult and direction of the spark less achievable. One type of fire starter tool includes a cylindrical chamber containing piece of flint that may partially direct the produced spark by producing the spark within the chamber whereby the spark travels out of the chamber's open end. A problem with this approach is that the time that the spark is inside the chamber subtracts from the overall life of the spark. Another problem with the type of tool is that weather elements may still dampen the chamber.

Therefore, what is clearly needed is a spark-based fire starter tool that directs the generated sparks directly to an ignitable tinder that is protected by the tool structure from the elements.

BRIEF SUMMARY OF THE INVENTION

According to an embodiment of the present invention, a fire starter tool is provided and includes a hollow case body having an open end and a closed end, a support platform disposed linearly from the closed end of the case body, an arcuate spark tunnel disposed on the end of the support platform the spark tunnel having a first open end facing the support platform and a second open end facing downward, a spark rod mounted to the support platform between the closed end of the case body and the first open end of the spark tunnel, a striker plate contained within the case body, and a cap for closing the open end of the case body.

In one embodiment, the case body, support platform, spark tunnel, and cap are manufactured from a thermally resistant polymer material. In a preferred embodiment, the case body, support platform, and spark tunnel are linearly oriented and wherein the spark tunnel has a curvature from horizontal to orthogonal. In one embodiment, the spark rod is elongated and annular and is seated in a recess disposed longitudinally on the center of the support platform, one end of the spark rod inserted into an opening in a front wall of the closed end of the case body. In one embodiment, the spark rod is glued onto the support platform. In another embodiment, the spark rod is snapped onto the support platform.

In a preferred embodiment, the first open end of the spark tunnel faces the open end of the spark rod and is faced at a retreating angle from vertical. In a preferred embodiment, the plane of second open end of the spark tunnel is generally orthogonal to the plane of the first open end of the spark tunnel within an offset range of sixty degrees to ninety degrees from vertical. In one embodiment, the striker plate is rectangular and includes a symmetrical step down in width dimension along a portion of the length thereof. In one embodiment, the case body, support platform, and spark tunnel are separate parts assembled. In one embodiment, the tinder material is stored within the case body along with the striker plate when not in use.

In one embodiment, the case body includes a pair of nubs that fit into a pair of divots provided on the inside sidewalls of the cap enabling the cap to be snapped on, unsnapped, and removed. In one embodiment, the inside of the case body includes a pair of opposing corners to seat the narrower stepped down end of the striker plate. In a preferred embodiment a wall of the open end of the case body is materially relieved to expose the rounded end of the striker plate used as a handle.

According to an embodiment of the present invention, a method is provided for starting a fire using a fire starter tool including a case body containing a striker plate, the case body connected to a support platform supporting a spark rod in a fixed position, and a spark tunnel connected to the support platform for catching sparks and redirecting said transiting sparks onto an amount of tinder, the method including; (a) preparation and placement of tinder to be ignited, (b) retrieving the striker plate from the case body, (c) striking the spark rod using the striker plate in the direction of the spark tunnel, (d) capturing the sparks from (c) and redirecting them through the tunnel form onto the tinder, and (e) upon satisfactory ignition of tinder, removing the fire starter tool from the tinder and putting the striker plate back in the case body.

According to one aspect of the method in (a) tinder may include wick material that is frayed to make it more ignitable. In a preferred aspect in (c) the striker plate has a handle end and a striking end and is held orthogonally to the direction of the spark rod when striking the rod toward the spark tunnel. In a preferred aspect in (d) the sparks are deflected through the tunnel in a downward arc and onto the prepared tinder of (a). In one aspect in (e) the striker plate includes an anchor opening and is tethered to the case body the plate and tether fitted into the case body and a cap placed on the end of the case body. In one aspect, the tinder is stored in the case body with the striker plate.

DETAILED DESCRIPTION OF THE INVENTION

In various embodiments described in enabling detail herein, the inventor provides a unique tool for concentrating generated sparks to ignite a fire tinder. One goal of the present invention is to provide a spark producing fire starter tool that directs and concentrates generated sparks toward an ignitable tinder placed at a specific location on the tool. Another goal of the invention is to provide a tool architecture that reduces exposure of the tinder material to the elements of weather including mist, rain, and wind. The present invention is described using the following examples, which may describe more than one relevant embodiment falling within the scope of the invention.

Figure 1:
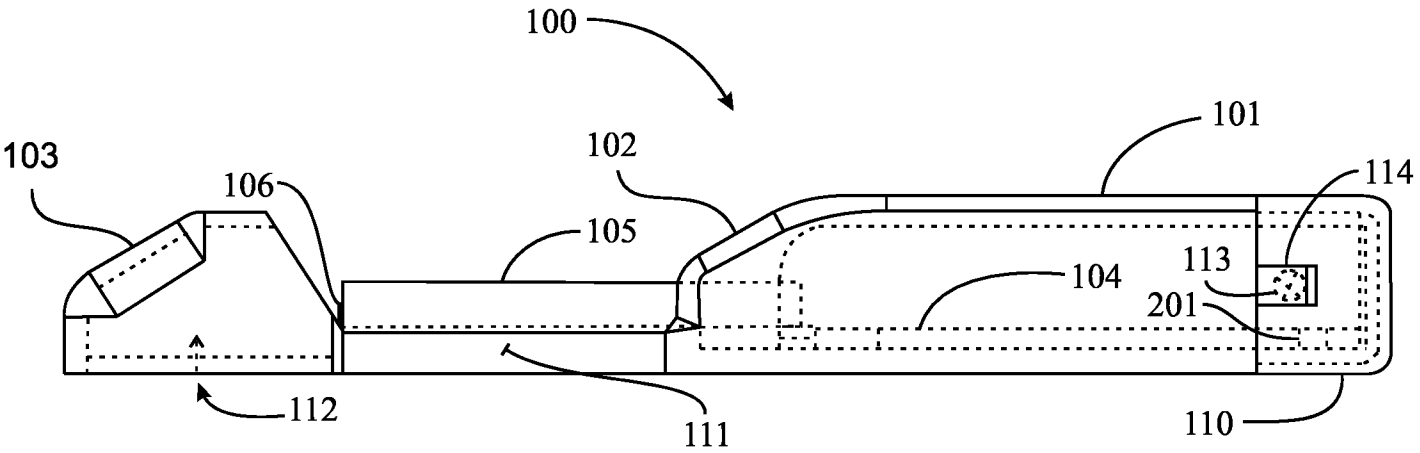
FIG. 1 is a right-side elevation view of a fire starter tool according to an embodiment of the present invention.

FIG. 1 is a right-side elevation view of a fire starter tool 100 according to an embodiment of the present invention. Fire starter tool 100, hereinafter referred to in this specification as tool 100, is adapted to concentrate and direct sparks directly onto a concentrated amount of tinder used to start a fire. Tool 100 includes a hollow storage case body 101 that has an internal volume adapted to contain a striker plate 104 for use in shaving sparks from a fixed position spark rod 105. Spark rod 105 may be iron, steel, magnesium, or another sparking metal. In this embodiment, tool 100 includes an end cap 110 that fits over the open end of case body 101 and may be snapped onto the end of the case body over rounded snap nubs 113 (one each side). End cap 110 is provided to secure striker plate 104 within case body 101 and perhaps to enable storage of an amount of dry fire starter material (not illustrated) like tinder material or, in one application, a length of ignitable wick having at least one frayed end to better facilitate spark ignition from emitted sparks.

Case body 101 functions as a handle for striker tool 100. Case body 101 may be opened at one end thereof by removing end cap 110 for the purpose of enabling a user to remove and replace striker plate 104 during use of tool 100 as well as providing access to any stored fire tinder materials or perhaps other small tools or accessories. In this embodiment, end cap 110 is provided for closing the open end of case body 101, however an end cap is not specifically required to practice the present invention. In this embodiment, end cap 110 may snapped onto case body section 101 via snap nubs 113 formed on case body 101, the snap nubs fitting into recessed provided in the sidewalls of the end cap.

Case body 101 slopes angularly downward at the front end thereof forming a conical nose portion 102 of case body 101 effectively closing that end of the case body. Nose portion 102 has a front wall adapted to seat spark rod 105 at one end of the spark rod. Spark rod 105 may be fixed to or removably attached to an elongate support platform 111 of fire starter tool 100 that extends from the end of nose portion 102 of case body section 101, at least the full length of spark rod 105. A stop wall 106 is provided and disposed at the far end of spark rod 105 from case body 101 and may, in one embodiment, provide a stop support for aiding the structural placement of spark rod 105 support platform 111. In a preferred embodiment, spark rod 105 is solidly positioned within tool 100 along the center of support platform 111 so it may be struck repetitively by a user operating handheld striker plate 104 to shave sparks from rod 105.

Striker tool 100 includes a hollow spark tunnel 103 provided for receiving sparks shed from spark rod 105 due to the directional emission of the sparks due to contact of striker plate 104 against the spark rod during operation. Spark tunnel 103 has a first open end for receiving sparks directed into it. Spark tunnel 103 has an inside diameter functioning as a spark deflecting and directing tunnel to direct emitted sparks received in the open end downward along a somewhat arcuate pathway to a second horizontal opening 112 placed through the floor of the striker tool 100. Spark tunnel 103 functions to protect sparks in transit there through from weather elements by enveloping over opening 112 where the sparks pass through to land on tinder material in a concentrated manner. In this embodiment, the first open end of spark tunnel 103 is angled away from horizontal to about 120 degrees or 30 degrees from vertical. The angled surface enhances the footprint to catch sparks emitted from spark rod 105.

Fire starter tool 100 may be manufactured from a durable light weight polymer material of high thermally resistant polymer such as a thermal plastic able to withstand any heat from sparks or ignited tinder. In one embodiment, fire starter tool 100 is materially contiguous and may be fabricated from a square thick-walled plastic tubing having a high thermal threshold. In another embodiment, fire starter 100 may be fabricated in sections that are assembled without departing from the spirit and scope of the present invention. In another embodiment fire starter tool 100 may be molded. In one embodiment, fire starter tool may be machined from a metal like aluminum.

Fire starter tool 100 may have an overall length of about 12 inches but may be longer or shorter without departing from the spirit and scope of the invention. Fire starter tool 100 may have a uniform width dimension and a similar or same overall height dimension with respect to case body 101 holding to a square tubing size of perhaps one and a half inches to two inches outside diameter. Fire starter tool 100 has an advantage over other types of sparking tools in that it catches, concentrates, and redirects shaved sparks received into spark tunnel 103 orthogonally downward through opening 112 and directly onto tinder. Spark tunnel 103 protects the transiting sparks from breezes, wind, drizzle, rain, dust, and other weather elements that may otherwise quench a spark or redirect the spark away from a tinder pile.

The first opening facing spark rod 105 functions to catch sparks shaved from spark rod 105 by a user applying striker plate 104, held in one hand, substantially orthogonal to the direction of the spark rod 105, an operator striking the outside of rod 105 at a strategic angle toward spark tunnel 103. The inside walls of spark tunnel 103 may function to concentrate and redirect sparks received through the first opening during striking toward second opening 112 oriented roughly in the same horizontal plane as support platform 111. Sparks that pass-through spark tunnel 103 are focused directly downward onto tinder by virtue of holding the fire starter tool just above the tinder where spark tunnel 103 and opening 112 are positioned directly above the ignitable tinder.

In one embodiment of the invention, a highly flammable wick material (not illustrated) may be provided of a diameter and length that enables the user to store the wick material inside case body 101 along with striker tool 104. In this embodiment, a purposely frayed end of the wick may be placed on a tinder pile where sparks passing through opening 112 are concentrated onto that flammable wick material. A user may remove cap 110 and retrieve striker plate 104 from within case body 101 and may begin striking rod 105 toward spark tunnel 103.

Striker plate 104 may have a central opening 201 provided through the material close to one end of the striker plate held as a handle to provide an anchor for a tether or cord connecting the striker plate to the inside of case body 101, the tether or cord of a length sufficient that is does not inhibit operation and can be stored within case body 101 along with the striker plate. Spark tunnel 103 further concentrates sparks toward the frayed end of a wick by virtue of design wherein the inside walls and roof of the spark tunnel 103 provide spark deflective and directive surfaces that direct the transiting sparks down through opening 112 in a concentrated manner.

The top and sidewalls of spark tunnel 103 prevent rain or water mist from contacting the sparks passing through. A general conical hood shape of spark tunnel 103 inhibits breezy conditions within the hollow space. In this embodiment, the user may drop the wick onto a pile of tinder and after it is ignited at proximity using fire starter tool 100, more tinder and flammable fire materials can be added. Fire starter tool 100 may be used to start a fire on the ground, in a stove, or fire hearth where a larger fire will be built. In another embodiment, loose tinder such as wood shavings, dried grass, or char cloth might be used as tinder in addition to or in place of a wick material without departing from the spirit and scope of the invention.

Figure 2:
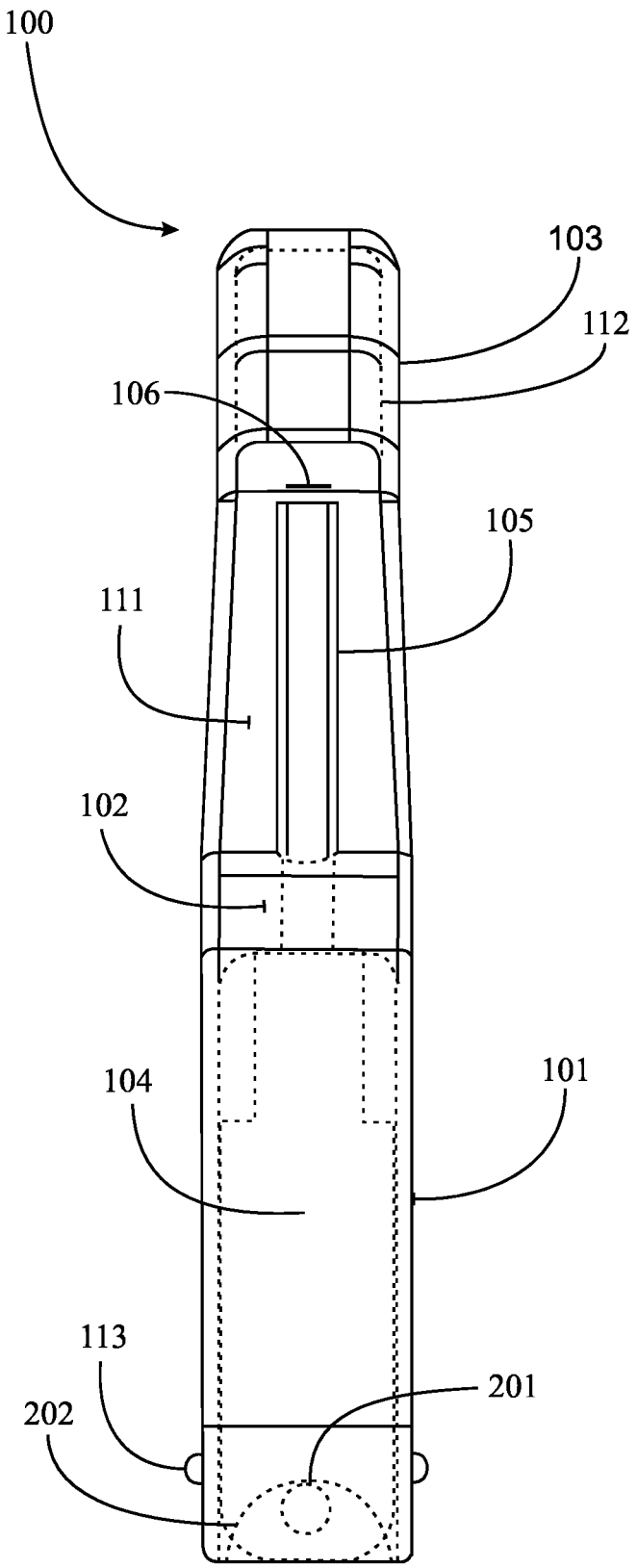
FIG. 2 is an overhead view of the fire starter tool of FIG. 1.

FIG. 2 is an overhead view of spark concentrating fire starter tool 100 of FIG. 1. In this embodiment, case body 101 and nose section 102 have a uniform width that tapers down evenly along support platform 111 to a lesser width dimension of spark tunnel 103. In one embodiment, fire starter tool 100 is a molded piece. In another embodiment, fire starter tool 100 is an assemblage of various parts including case body section 101, nose section 102, support platform 111, and spark tunnel 103. In a variation of this embodiment, fire starter tool 100 may have a solid contiguous floor whereupon the various parts may be mounted or otherwise attached or assembled. Striker plate 104 is logically represented inside case body 101 in this view by broken boundary. End cap 110 is removed in this view of striker tool 100. Case body 101 and nose portion 102 are edge-rounded at the exposed edges to provide an ergonomic gripping form for use as a handle of striker tool 100 having no sharp edges.

In this embodiment, striker plate 104 is flat edged and stepped down in width at one end of the plate designed to strike spark rod 105 and wider and radiused at the other end of the plate used as a handle. The flat sharp edges and corners of striker plate 104 are maintained for spark production when the plate is brought against rod 105. The rounded edge of striker plate 104 is gripped by the user in one hand while fire starter tool 100 is gripped by the opposite hand of the user. The user generates sparks from striking rod 105 using striker plate 104 horizontally and at an acute angle toward the direction of spark tunnel 103.

Spark tunnel 103 is formed like an elbow closed at the rear end of the form and open at the front end of the form (first opening). The opening of spark tunnel 103 is angled rearward toward the closed end of the form for the purpose of optimizing the footprint of the first opening relative to the random semi-accurate paths that the generated sparks take from the point of being shaved off rod 105. In one embodiment, a hinged lid may be provided in place of an end cap 110 for closing the end of case body 101. In one embodiment, striker plate 104 may be snapped into case body 101 or may be inserted into opposing slots provided for the purpose in the sidewalls of case body section 101. In another embodiment, striker plate 104 fits loosely within case body 101 and rests upon the floor of the case body. Striker plate 104 may be formed of flint material or another stone material such as quartz, chert, agate, or another stone material.

In this embodiment, spark rod 105 is positioned on support platform 111 in line with the longitudinal center of striker tool 100 and the vertical center line of spark tunnel 103. In one embodiment, spark rod 105 may seat within a depression in support platform 111 and may extend partially into or through the wall at the end of nose portion 102. In this embodiment, an opening may be provided for the purpose of seating rod 105 at least partially within nose portion 103. The opening may be just larger than the diameter of rod 105 to allow a press fit. In one embodiment, stop wall 106 prevents rod 105 from moving side-to-side or from rising or being inadvertently kicked up from support platform 111.

In one embodiment, striker plate 104 includes a centered opening 201 placed vertically there through around a full radius point at the radiused end of the plate. In one embodiment, a user may tie the tinder wick material to striker plate 104 using opening 201 so that the wick material does not inadvertently become separated from fire starter tool 100. In one embodiment, striker plate 104 may be tied to case body section 101 so that the striker plate is not inadvertently separated from fire starter tool 100. Case body section 101 includes a radiused material relief opening 202 (broken boundary) at the bottom side of the case to enable the user to grasp striker plate 104 from an open case body section 101 more easily than would be the case without the material relief feature. Opening 112 is logically depicted by broken boundary.

Figure 3:
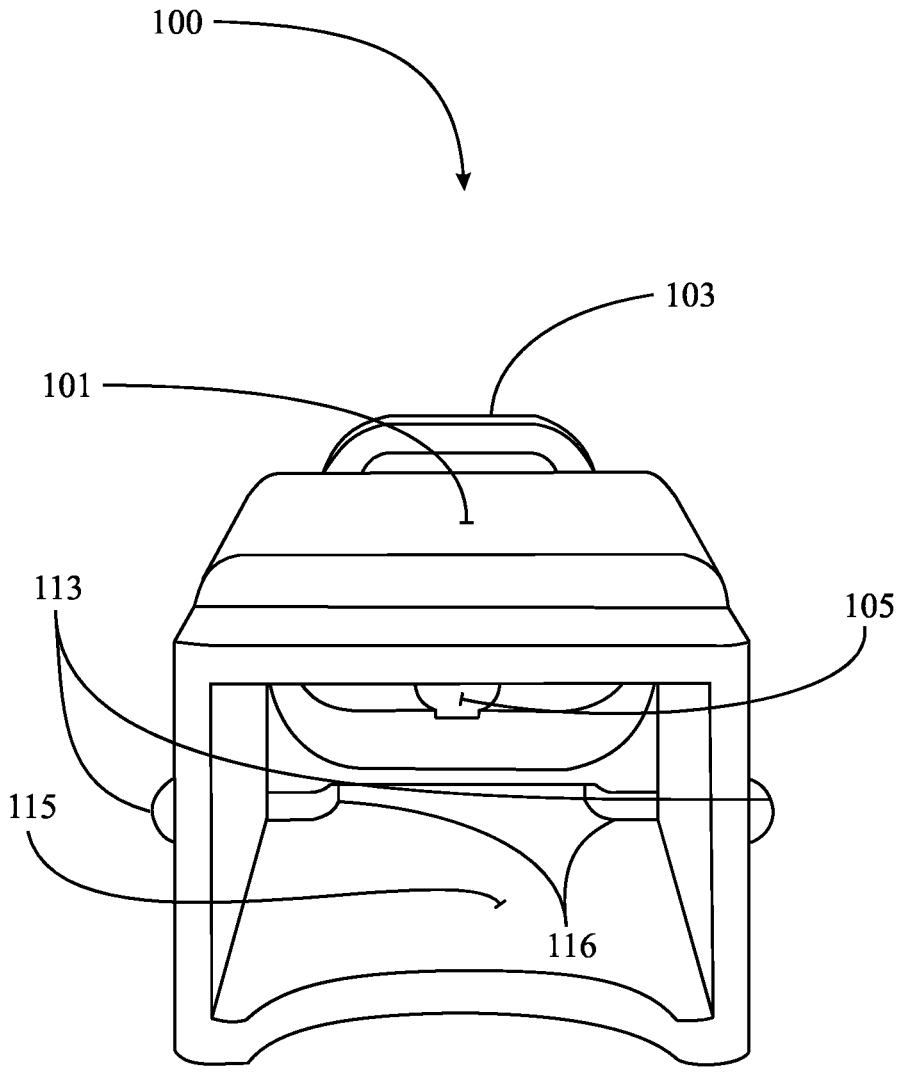
FIG. 3 is a perspective end view of the fire starter tool of FIG. 1A.

FIG. 3 is a perspective end view of fire starter tool 100 of FIG. 1A. In this view, end cap 110 is removed for clarity. Case body section 101 is rectangular and has a floor 115. In one embodiment, striker plate 104 rests upon floor 115 in case body 101 when not in use. In one embodiment, more than one striker plate like striker plate 104 may be stored within case body section 101 of fire starter tool 100 without departing from the spirit and scope of the invention. Tinder material including char cloth and wick material may also be stored within case body section 101 to keep it dry before use. The top portion of spark tunnel 103 is visible in this view. In this view the rear end of rod 105 is visible seated through the front wall of nose portion 102.

In this embodiment, case body 101 includes a pair of plate stop corners 116 forming a seat for accepting the narrow end of striker plate 104. The inside diameter between corners 116 may be just larger than the outside diameter of the stepped down portion of striker tool 104 enabling a friction fit at least for a portion of the length of the narrower side of the striker plate. Snap nubs 113 provide holds for end cap 110 described further above in FIG. 1. Other design features intended to secure a striker plate within case body 101 and or to retain an end cap may be provided to case body 101 without departing from the spirit and scope of the invention.

Figure 4:
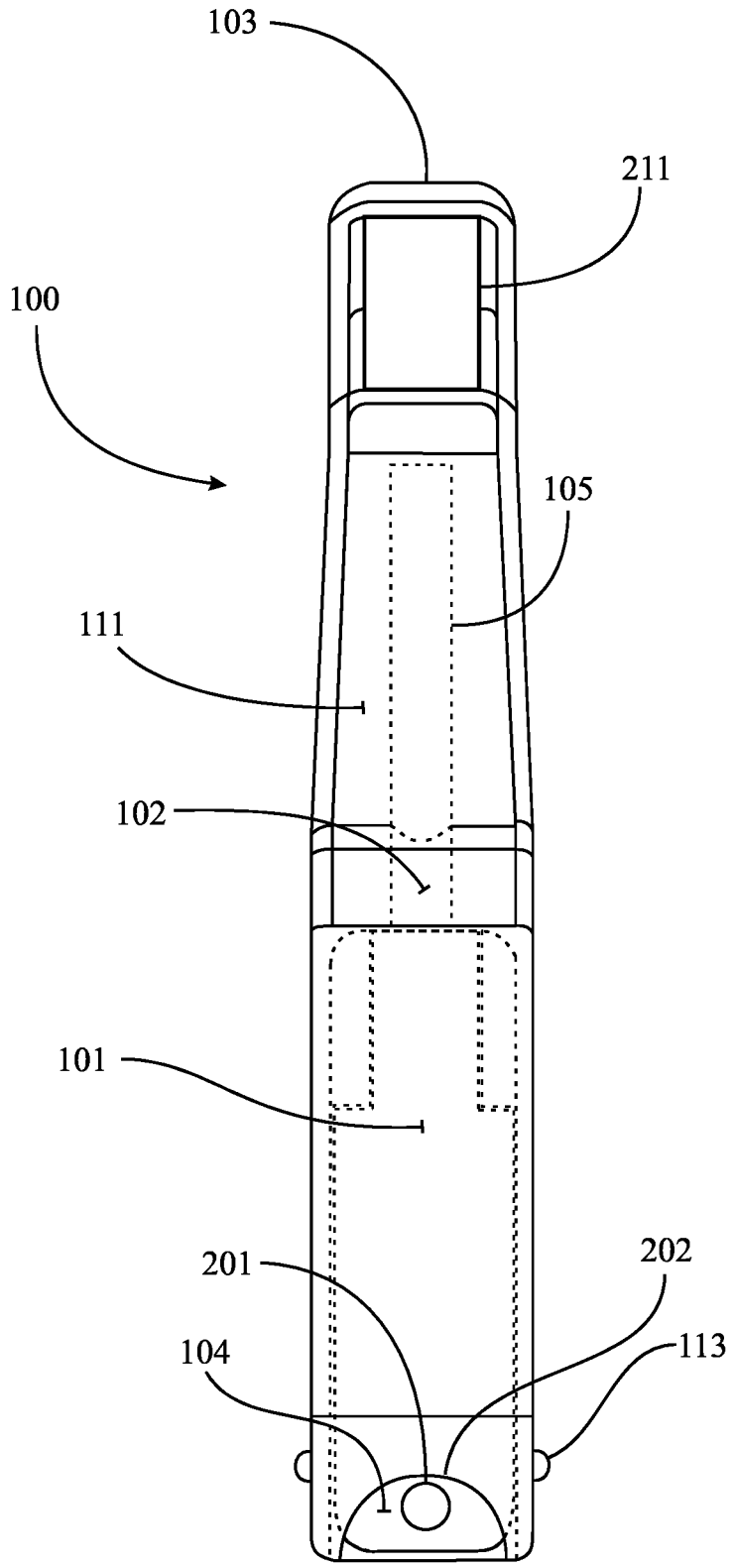
FIG. 4 is an underside view of the fire starter tool of FIG. 1.

FIG. 4 is an underside view of spark concentrating fire starter tool 100 of FIG. 1. In this embodiment, the bottom side of fire starter tool 100 is one contiguous piece shared by all the sections of the tool. Support platform 111 supports spark rod 105. Opening 112 is disposed beneath, and largely within, the footprint of spark tunnel 103 and may serve as the second end of the spark tunnel. Striker plate 104 is partly visible in this view through material relief feature 202 placed through the bottom edge of case body section 101. In this view, end cap 110 is removed for clarity. End cap 110 may fit over the edges of case body section 101 and may be retained by snap nubs 113. In a preferred embodiment, end cap 110 may be snapped on to the end of body section 101. In still another embodiment, end cap 110 may be hinged and may be opened to one side of the case body section to open it. Material relief feature 202 enables the user to see striker plate 104 with the end cap 110 removed.

Figure 5A:
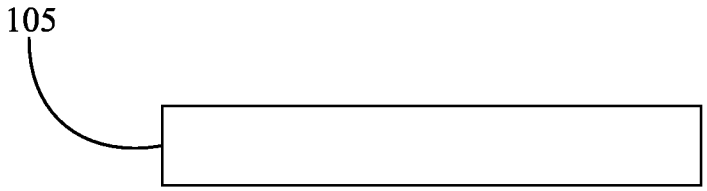
FIG. 5A is a side elevation view of the spark rod of the fire starter tool of FIG. 1A.
Figure 5B:
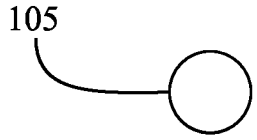
FIG. 5B is an end view of the spark rod of FIG. 5A.

FIG. 5A is a side elevation view of spark rod 105 of spark concentrating fire starter tool 100 of FIG. 1A. FIG. 5B is an end view of spark rod 105 of FIG. 5A. Referring to both FIG. 5A and FIG. 5B, spark rod 105 may have an overall length of about four inches and a diameter of about three-eighths of an inch. In this embodiment, rod 105 is annular. In another embodiment, rod 105 may be square or may be formed of another geometric shape without departing from the spirit and scope of the present invention.

Figure 5C:
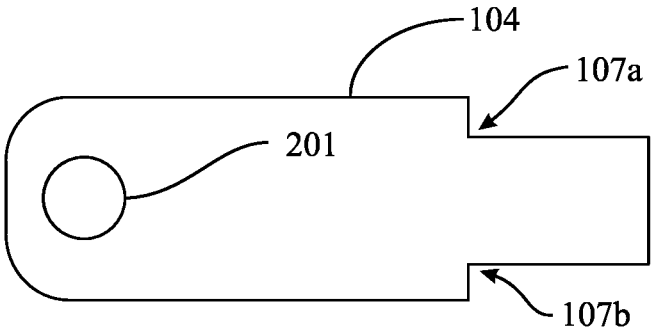
FIG. 5C is an overhead view of the striker plate of the fire starter tool of FIG. 1A.
Figure 5D:
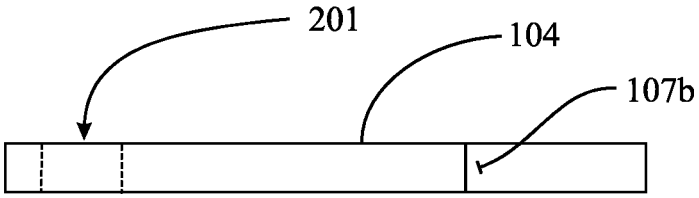
FIG. 5D is a side elevation view of the striker plate of FIG. 5C.

FIG. 5C is an overhead view of striker plate 104 of fire starter tool 100 of FIG. 1A. FIG. 5D is a side elevation view of striker plate 104 of FIG. 5C. Referring now to FIG. 5C, striker plate 104 has an overall length of about five to five-and one-half inches in one embodiment. Striker plate 104 has a primary overall width dimension in this embodiment of about one to one-and-one-half inches. The handle end of striker plate 104 is fully radiused. Opening 201 may have a diameter of about one quarter inch. Striker plate 104 has a symmetrical step-down feature in width resulting in corners 107*a* and 107*b* demarcating a striking end of the plate having a smaller width at a length sufficient for defining a striking area of the plate differentiating from the handle portion of the plate. In this embodiment, corners 107*a* and 107*b* are opposing 90-degree corners having sharp edges. Corners 107*a* and 107*b* aid the operator in locating striker plate 104 against the spark rod 105 and prevents slip off by using the corners to locate against the spark rod. Either side of striker plate 104 may be used to shave sparks off spark rod 105.

Referring now to FIG. 5D, striker plate 104 has a uniform thickness of about one eighth of an inch. Opening 201 extends through the striker plate 104 and provides a tie anchor for carrying the striker plate 104 on a key ring, a tether, or tying a wick thereto to keep the material connected to the plate until use.

Figure 6A:
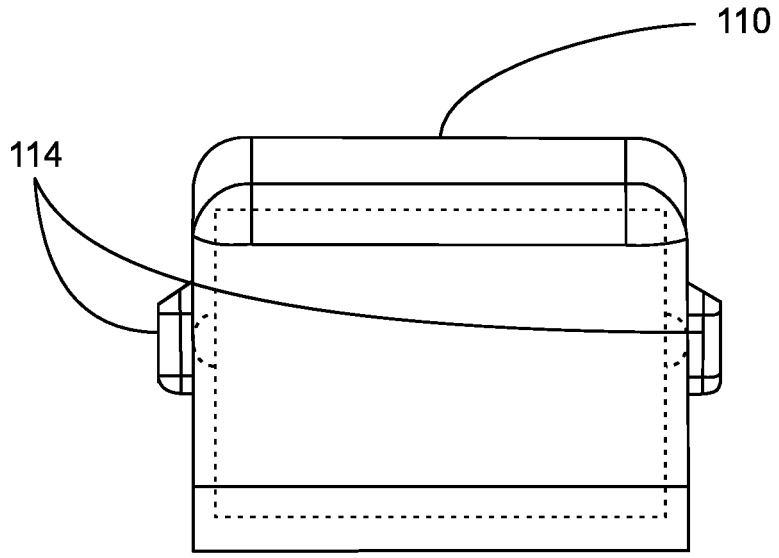
FIG. 6A is a rear elevation view of the end cap of FIG. 1.
Figure 6B:
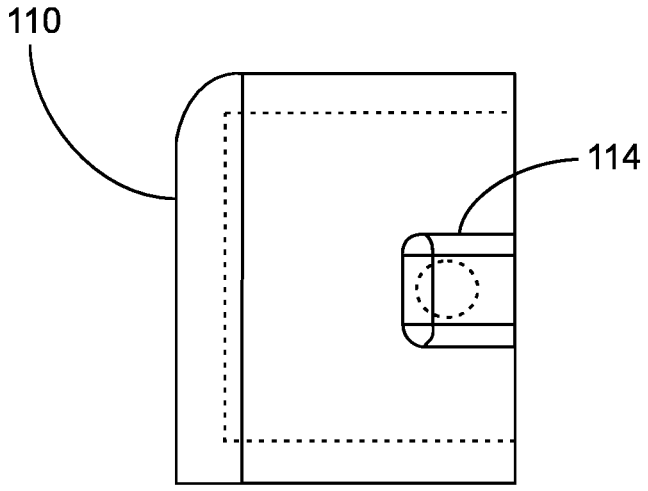
FIG. 6B is a right-side elevation view of the end cap of FIG. 6A.

FIG. 6A is a rear elevation view of end cap 110 of FIG. 1. FIG. 6B is a right-side elevation view of end cap 110 of FIG. 6A. Referring now to FIG. 6A, end cap 110 is a rectangular end cap in this embodiment that fits over the outside of case body 101 described further above. End cap 110 may be molded or otherwise fabricated of a high thermal resistant durable polymer material. End cap 110 has a pair of annular divots 108 provided on the opposing walls on the inside of the cap. Divots 108 are designed to align with and to catch snap nubs 113 to locate end cap 110 in the proper snapped to position on the end of case body 101.

End cap 110 includes finger tabs 114 provided strategically to facilitate divots 108 in a somewhat flexible manner allowing for snap on and snap from the end cap. Referring now to FIG. 6B, end cap 110 is depicted inside elevation. A user may push end cap 110 on to case body 101 until the annular divots 108 locate over snap nubs 113 on the case body thus securing the cap to the case body. Removing end cap 110 from case body 101 is the reverse of installation.

Figure 7:
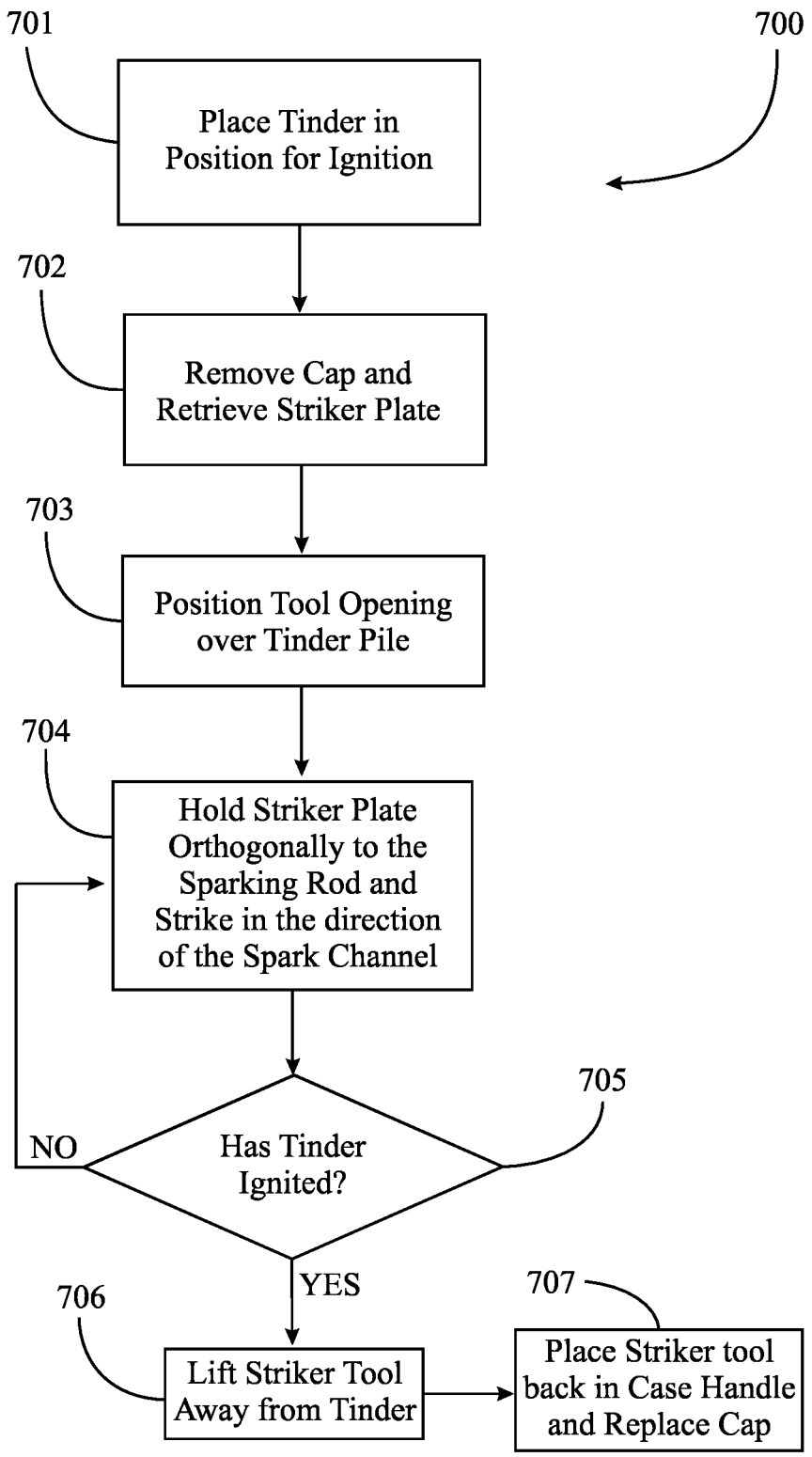
FIG. 7 is a process flow chart depicting steps for starting a fire with the fire starter tool of FIG. 1.

FIG. 7 is a process flow chart 700 depicting steps for starting a fire with the fire starter tool of FIG. 1.

At step 701, a user operating fire starter tool 100 may prepare tinder by placing the tinder in a position for ignition. For example, tinder may be removed from case body 101 described above and placed on a fire spot where a fire will be started.

At step 702, the user may remove the end cap and retrieve the striker plate. In one embodiment, the user removes the tinder and the striker plate from the case body in a same step.

At step 703, the user may position the fire starter tool 100 directly over and in proximity of the placed tinder of step 701 holding the tool with one hand.

At step 704, the user may hold the striker plate orthogonal to the spark rod and strike the rod repeatedly in a whittling motion shaving sparks off toward the spark tunnel at the far end of the tool. The sparks travel through the spark tunnel and exist the tunnel through the bottom opening just above the tinder material.

At step 705 the user may determine if the tinder has ignited. If at step 705 it is determined that the tinder is not yet ignited, then the process loops back to step 704 and more sparks are emitted from the spark rod through the spark tunnel. If at step 705 it is determined that the tinder has sufficiently been ignited, then at step 706 the user may lift the fire starter tool from the burning tinder. The user may then replace the striker plate back into the case body and replace the end cap at step 707.

It will be apparent to one with skill in the art that the fire starter tool of the present invention may be provided using some or all the elements described herein. The arrangement of elements and functionality thereof relative to the fire starter tool of the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A fire starter tool comprising:

a hollow case body having an open end and a closed end;

a support platform having a top planar surface, the support platform disposed linearly from the closed end of the case body;

an arcuate spark tunnel disposed on an end of the support platform away from the hollow case body the spark tunnel having a first open end facing the support platform and a second open exit facing downward opposite the top planar surface;

a spark rod mounted to the top planar surface of the support platform between the closed end of the case body terminating at the first open end of the spark tunnel;

a striker plate contained within the case body section; and a cap for closing the open end of the case body;

wherein a spark created by striking the spark rod with the striker plate travels linearly through the first open end and is redirected by the tunnel to the exit.

2. The fire starter tool of claim 1, wherein the case body, support platform, spark tunnel, and cap are manufactured from a thermally resistant polymer material.

3. The fire starter tool of claim 1, wherein the case body, support platform, and spark tunnel are linearly oriented and wherein the spark tunnel has a curvature from horizontal to orthogonal.

4. The fire starter tool of claim 1, wherein the spark rod is elongated and annular and is seated in a recess disposed longitudinally on the center of the support platform, one end of the spark rod inserted into an opening in a front wall of the closed end of the case body.

5. The fire starter tool of claim 4, wherein the spark rod is glued onto the support platform.

6. The fire starter tool of claim 4, wherein the spark rod is snapped onto the support platform.

7. The fire starter tool of claim 1, wherein the first open end of the spark tunnel faces the open end of the spark rod and is faced at a retreating angle from vertical.

8. The fire starter tool of claim 7, wherein the plane of second open end of the spark tunnel is generally orthogonal to the plane of the first open end of the spark tunnel within an offset range of sixty degrees to ninety degrees from vertical.

9. The fire starter tool of claim 1, wherein the striker plate is rectangular and includes a symmetrical step down in width dimension along a portion of the length thereof.

10. The fire starter tool of claim 1, wherein the case body, support platform, and spark tunnel are separate parts assembled.

11. The spark emitting fire starter tool of claim 1, wherein tinder material is stored within the case body along with the striker plate when not in use.

12. The fire starter tool of claim 1, wherein the case body includes a pair of nubs that fit into a pair of divots provided on the inside sidewalls of the cap enabling the cap to be snapped on, unsnapped, and removed.

13. The starter tool of claim 1, wherein the inside of the case body includes a pair of opposing corners to seat a narrower stepped down end of the striker plate.

14. The fire starter tool of claim 1, wherein a wall of the open end of the case body is materially relieved to expose a rounded end of the striker plate used as a handle.

15. A method for starting a fire using a fire starter tool including a case body containing a striker plate, the case body connected to a support platform supporting a spark rod in a fixed position on a top planar surface of the support platform the spark rod terminating at a spark tunnel connected to the support platform for catching sparks and redirecting said transiting sparks onto an amount of tinder comprising:

(a) preparation and placement of tinder to be ignited;

(b) retrieving the striker plate from the case body;

(c) striking the spark rod using the striker plate in a linear direction of the spark tunnel;

(d) capturing the sparks from (c) in the tunnel and redirecting them through the arc of the tunnel at an exit opening of the tunnel opposite the top planar surface, depositing the sparks onto the tinder;

(e) upon satisfactory ignition of tinder, removing the fire starter tool from the tinder and putting the striker plate back in the case body.

16. The method of claim 15, wherein in (a) tinder may include wick material that is frayed to make it more ignitable.

17. The method of claim 15, wherein in (c) the striker plate has a handle end and a striking end and is held orthogonally to the direction of the spark rod when striking the rod toward the spark tunnel.

18. The method of claim 15, wherein in (d) the sparks are deflected through the tunnel in a downward arc and onto the prepared tinder of (a).

19. The method of claim 15, wherein in (e) the striker plate includes an anchor opening and is tethered to the case body, the plate and tether fitted into the case body and a cap placed on the end of the case body.

20. The method of claim 15, wherein the tinder is stored in the case body with the striker plate.

* * * * *